US005366403A

United States Patent [19]

Weiss

[11] Patent Number: 5,366,403

[45] Date of Patent: Nov. 22, 1994

[54] FLYING DISC

[76] Inventor: Barney Weiss, 3410 Paul Ave., Bronx, N.Y. 10468

[21] Appl. No.: 105,867

[22] Filed: Aug. 11, 1993

[51] Int. Cl.[5] ..... A63H 27/00; A63B 65/10

[52] U.S. Cl. ..... 446/46; 446/48; 273/425; 273/428

[58] Field of Search ..... 206/640, 642; 446/46, 446/47, 48, 34, 236; 273/332, 334, 335, 424, 425, 428, 126 R, 127 A

[56] References Cited

U.S. PATENT DOCUMENTS

| | | | |
|---|---|---|---|
| 95,742 | 10/1869 | Stevens | 220/642 |
| 2,237,102 | 4/1941 | Hungerford | 220/642 |
| 2,342,715 | 2/1944 | Wilson | 220/642 X |
| 3,594,945 | 7/1971 | Turney | 273/425 X |
| 3,680,733 | 8/1972 | Winslow | 220/642 |
| 3,710,505 | 1/1973 | Linenfeiser . | |
| 4,173,839 | 11/1979 | Kovac | 446/46 |
| 4,176,843 | 12/1979 | DeWitt, Jr. | 446/46 |
| 4,204,357 | 5/1980 | Harrington | 446/69 X |
| 4,223,473 | 9/1980 | Brown . | |
| 4,241,533 | 12/1980 | Newsome . | |
| 4,290,226 | 9/1981 | Stauffer . | |
| 4,334,385 | 6/1982 | Melin et al. | 273/424 X |
| 4,334,385 | 6/1982 | Melin et al. . | |
| 4,335,536 | 6/1982 | Magid et al. . | |
| 4,351,129 | 9/1982 | Kerkenbush et al. | 446/46 |
| 4,425,734 | 1/1984 | Bauer | 446/48 |
| 4,568,297 | 2/1986 | Dunipace . | |
| 4,820,230 | 5/1989 | Richards . | |
| 5,078,637 | 1/1992 | McFarland . | |

FOREIGN PATENT DOCUMENTS

| | | | |
|---|---|---|---|
| 1104544 | 11/1955 | France | 220/642 |
| 2076671 | 5/1980 | United Kingdom . | |

OTHER PUBLICATIONS

"Frisbees" Washington Post Magazine, May 1977, pp. 46, 48 446/46.

*Primary Examiner*—Robert A. Hafer
*Assistant Examiner*—D. Neal Muir
*Attorney, Agent, or Firm*—Nolte, Nolte, and Hunter

[57] ABSTRACT

A system for converting disposable plastic or paper dinner plates into throwable flying discs. The system includes an annular foam ring. A groove is disposed on an inside surface of the annular ring. The groove receives an outer edge of the disposable plate, thereby removably securing the foam to the disposable plate. The groove has a depth which extends the groove's outer circumference to a circumference similar to an outer circumference of a standard sized, commercially available, disposable plate.

9 Claims, 2 Drawing Sheets

FLYING DISC

FIELD OF INVENTION

The present invention relates to flying discs, tossed by hand for amusement. Specifically it relates to a flying disc comprising a paper plate surrounded by a soft foam ring.

BACKGROUND OF THE INVENTION

Since the invention of the frisbee, multitudes of people have enjoyed tossing aerodynamically shaped discs for amusement to others who catch them in mid-flight and return the toss. These discs are tossed with a rotational motion. They spin as they pass through the air and actually fly in paths that may be straight or curved as the skill of the user allows.

Various patents refer to the application of a foam ring around the perimeter of a flying disc, generally with the object of reducing its impact upon landing or being caught.

U.S. Pat. No. 4,241,533 refers to an aerial glider with a flexible material middle and a foam ring around the edge.

British Patent 2,076,671 refers to a flexible body aerial disc with a ring molded around the edges. The patent says PVC is the preferred material of construction, but other materials may be used.

U.S. Pat. No. 4,223,473 refers to a toy aerial disc made from flexible material with a foam ring attached around the edges.

There are number of patents which refer to a foam ring around a throwing disc. However, none of the references teach a ring cooperatively shaped to fit annularly over the edge of a standard sized disposable paper or plastic dinner plate.

BRIEF DESCRIPTION OF THE INVENTION

The present invention comprises a flexible foam ring to be used specifically to convert an ordinary paper, plastic or foam plate into a flying disc similar to a frisbee. A slit on the inside of the ring makes it possible to accomplish this. Because paper plates are used, more than one plate can be used to increase rigidity. These plates can be decorated by children to make personal flying discs. They can also be cut to create a raised surface, imparting the look of flying space craft. The ring can be formed of any flexible foam material. Lamination can create many colorful combinations. A second plate can also be reversed opposite a first plate to create a dome on each side.

Because the ring is of foam, it creates a soft, safe toy for indoor use. The use of paper plate insert makes for a lighter, therefore easier to throw and safer-on-impact toy.

Fabrication cost of the assembly is low.

When the plate becomes old, dirty, or worn out it can be replaced easily by removing it from the slot in the ring and inserting a new plate.

The ring, when mounted on the plastic plate, floats and can thereby serve as a tray in a pool.

The foam ring may be designed with varying shapes to present the best aerodynamic surface so that the edges of the ring conform with the disposable food plates which are available in the market in 6", 7", 9", and 10" diameters, each of which diameters we define for the purposes of this application as a standard size.

The ring may be approximately 1" in diameter but may vary in dimension depending on the designs.

The ring is designed with a flanged edge at the groove for ease of insertion of a plate. The plate is removably clamped softly by the groove in the soft, resilient, annular foam ring.

DETAILED DESCRIPTION OF THE DRAWINGS

Figure 1:
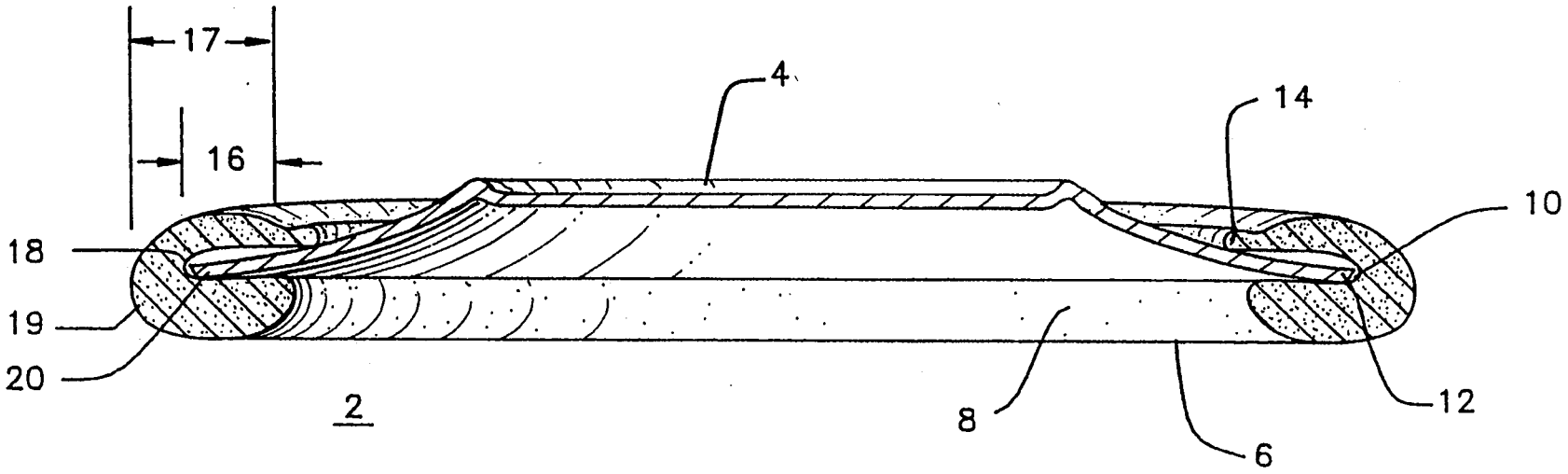
FIG. 1 is an elevational view in section, the section taken through a plane, indicated as line 1 in FIG. 2.
Figure 2:
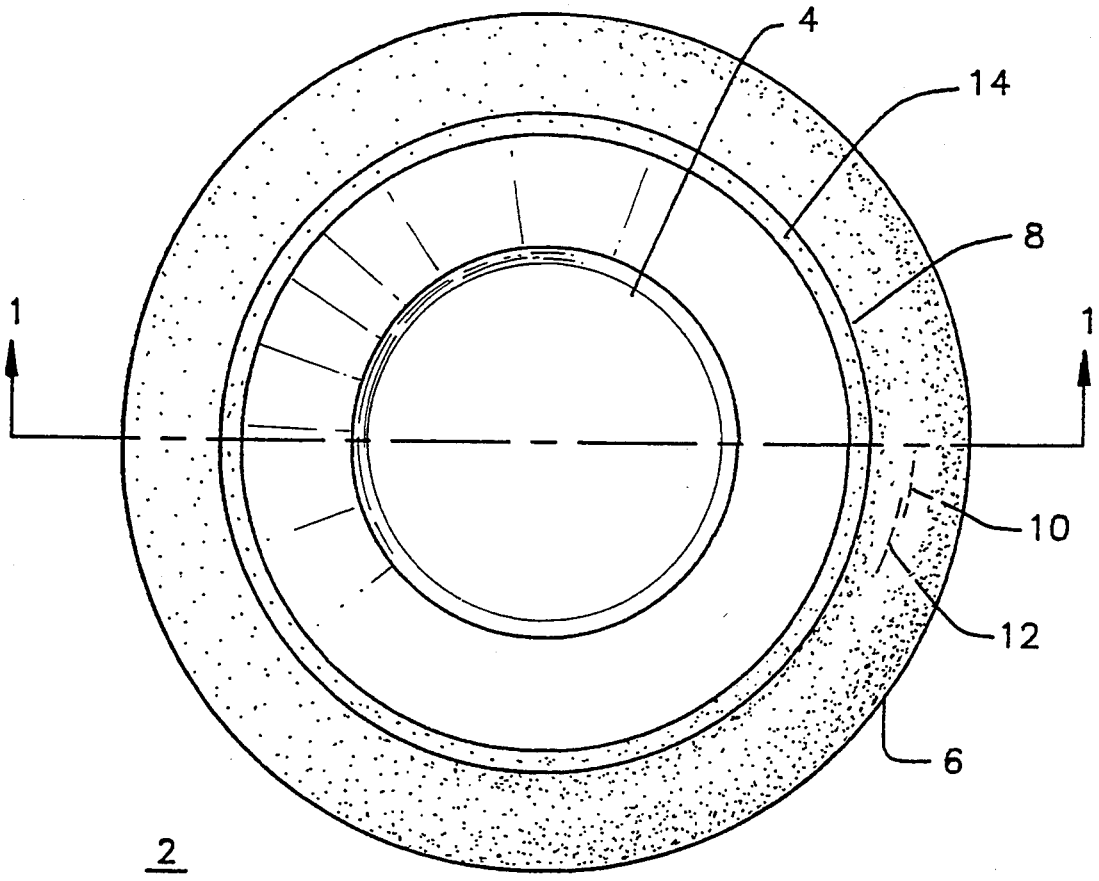
FIG. 2 is a plan view of the present invention.

FIG. 1, shows a cross section of a preferred embodiment taken through plane 1 indicated in FIG. 2. The disc, generally designated 2, comprises an inner paper plate 4 and a soft annular foam ring 6. On the inside of annulus 8 is a slit or groove 10 adapted to receive the outer rim 12 of a standard size, commercially available in supermarkets, disposable paper, plastic, or foam dinner plate, such as paper plate 4. Flange 14 is located at groove 10 to ease insertion of outer rim 12 of plate 4 into groove 10. Slit or groove 10 has depth 16 which extends the groove means' outer circumference 18 to a circumference similar to an outer circumference 20 of the standard size, commercially available, disposable plate 4.

As is shown in FIG. 1, the depth of this groove 16 is approximately half the cross-sectional horizontal dimension 17 of the annulus. Its depth is sufficient to cause the foam ring to grasp the plate securely when the edge of plate has been inserted into the groove.

An aerodynamic lifting shape is defined by round leading edge 19.

The flying disc is created by the following method. A ring such as described above is provided. The fabricator applies finger pressure on the grooveward side of flange 14, to open groove 10. The circumferential edge or outer rim 12 of the plate 4 is inserted into the open portion of the groove 10.

Then the fabricator continues around the edge applying pressure to adjacent points on the groove side of the flange to open the groove, and inserting adjacent portions of the outer edge of the plate into those open portions until the entire edge of the plate has been inserted into the groove.

This done, the throwing disc has been fabricated.

It is noted that advertising can be printed on either side of plate 4, thus, turning the disc into an inexpensive giveaway for promotional proposes.

These plates can be left blank and decorated by children or others having artistic inclinations.

Multiple plates 4 may be stacked on top of each other to increase rigidity and weight of the flying disc.

In an alternative embodiment, foam ring 6 may be sold as an extrusion in a linear fashion and glued in a ring to any circumference so as to encompass non-standard sized plates. For example, a large round pan might be converted into such a throwable disc with this arrangement.

In general the foam renders the throwable disc safer, and less damaging to property or persons, due to the light weight of the plates and the cushioning of the foam ring. Any person converting a large pan such as a pizza pan to a flying ring should exercise due care in its use, since the cushioning of the foam ring may not be entirely adequate to prevent injury if a heavy object is carelessly used. It is not recommended to place the foam ring around a heavy object, since it is always possible to create a throwing object so heavy that any foam padding would be inadequate to protect a person hit by such a heavy object.

We note that when a paper plate has become older or worn, or when a new design is desired, it is a simple matter to remove the outer ring and insert one or more new plates and thus renew the disc.

I claim:

1. A throwable flying disc comprising: a plate, of a plurality of interchangeable plates, said plates all being round, and of the same size;

an annular foam ring of an essentially circular shape having sufficient memory to return to said shape after deformation;

groove means, disposed on an inside surface of said annular foam ring, for receiving an outer edge of the plate therein and thereby removably securing said foam to said plate, said groove means having a depth and an outer circumference, said depth extending the groove means' outer circumference to a circumference similar to an outer circumference of the plate, said depth being sufficient to comprise means for grasping the plate securely in the ring.

2. Apparatus according to claim 1, in which said annular ring comprises a flange means, located at the groove means, said flange means for pressing open the groove means and thereby for insertion of the circumferential edge into the groove means.

3. A throwable flying disc according to claim 1 in which the plurality of interchangeable plates are of a group of standard sizes, said standard sizes consisting of the following diameters:

6 inch;
7 inch;
9 inch; and
10 inch.

4. A throwable flying disc according to claim 1 in which the annular foam ring has a rounded leading edge which, in combination with the plate, comprises an aerodynamic lifting shape.

5. A throwable flying disc comprising:

a disposable plate, of a plurality of standard size disposable plates;

said disposable plates all having a same diameter and a same outer circumference;

the disposable plate having an outer circumferential edge; an annular foam ring of an essentially circular shape having sufficient memory to return to said shape after deformation; and groove means, disposed on an inside surface of said annular ring, for removably receiving the outer circumferential edge of the disposable plate therein and thereby removably securing said foam to said disposable plate, said groove means having a depth and a groove outer circumference which depth extends the groove outer circumference to a circumference similar to the outer circumference of the standard size, commercially available disposable plate, said depth being sufficient to comprise means for removably securely attaching said foam to said plate;

said outer circumferential edge sized to cooperate with the groove means for securing the plate's edge to the ring.

6. Apparatus according to claim 5, in which said annular ring comprises a flange means, located at the groove means, said flange means for pressing open the groove means for insertion of the circumferential edge into the groove means.

7. A throwable flying disc according to claim 5 in which the plurality of standard size disposable plates are of a group of standard sizes, said standard sizes consisting of the following diameters:

6 inch;
7 inch;
9 inch; and
10 inch.

8. A throwable flying disc according to claim 5 in which the annular foam ring has a rounded leading edge which, in combination with the disposable plate, comprises an aerodynamic lifting shape.

9. A throwable flying disc comprising:

a disposable plate, of a plurality of standard size disposable plates;

said disposable plates all having a same diameter and a same outer circumference;

said plate having an outer circumferential edge;

an annular foam ring; groove means, disposed on an inside surface of said annular ring, for removably receiving the outer circumferential edge of the disposable plate therein and thereby securing said foam to said disposable plate, said groove means having a depth and an outer groove circumference;

said depth extending the groove outer circumference to a circumference similar to the outer circumference of the disposable plate, said depth being sufficient to comprise means for removably securely attaching said foam to said plate;

said plate having the outer circumferential edge sized to cooperate with the groove means for removably securing the plate's edge to the ring;

said annular ring comprising a flange means, for pressing open the groove means, and thereby for insertion of the circumferential edge into the groove means;

said flange means located at the groove means; the annular foam ring having a rounded leading edge which, in combination with the disposable plate, comprises an aerodynamic lifting shape;

the plurality of standard size disposable plates being of a group of standard sizes, said standard sizes consisting of the following diameters:

6 inch;
7 inch;
9 inch; and
10 inch.

* * * * *